United States Patent [19]

Hosey

[11] Patent Number: 4,831,759

[45] Date of Patent: May 23, 1989

[54] MODULATED INTERIOR VALANCE SYSTEM

[75] Inventor: Richard E. Hosey, Pedro, Ohio

[73] Assignee: Ashland Oil, Inc., Ashland, Ky.

[21] Appl. No.: 142,966

[22] Filed: Jan. 12, 1988

[51] Int. Cl.[4] ..... G09F 13/04

[52] U.S. Cl. ..... 40/564; 40/605; 40/618; 362/223

[58] Field of Search ..... 40/564, 618, 642, 606; 362/223

[56] References Cited

U.S. PATENT DOCUMENTS

| | | | |
|---|---|---|---|
| 1,668,289 | 5/1928 | Smiley . | |
| 1,843,883 | 2/1932 | Pogue . | |
| 1,902,769 | 3/1933 | Esdorn . | |
| 2,293,642 | 8/1942 | Donaldson . | |
| 2,507,350 | 5/1950 | Russell | 40/130 |
| 2,541,303 | 2/1951 | Smith | 40/564 |
| 2,622,356 | 12/1952 | Valente | 40/132 |
| 2,939,235 | 6/1960 | Wamser | 40/132 |
| 3,102,365 | 9/1963 | Whitesell | 40/564 |
| 3,210,875 | 10/1965 | Schwenkler | 40/129 |
| 3,238,654 | 3/1966 | Rosenak et al. | 40/618 |
| 3,325,936 | 6/1967 | Swartz | 40/564 |
| 3,418,738 | 12/1968 | Goodman | 40/618 |
| 3,500,561 | 3/1970 | Simmons | 40/564 |
| 3,555,715 | 1/1971 | Shell | 40/618 |
| 3,675,006 | 7/1972 | Zagel et al. | 240/9 |
| 3,707,792 | 1/1973 | Mabrey et al. | 40/219 |
| 3,890,728 | 6/1975 | Schubert | 40/140 |
| 4,081,665 | 3/1978 | Corbeil | 362/223 |
| 4,339,129 | 7/1982 | Gautraud | 273/54 |
| 4,512,098 | 4/1985 | Ready | 40/564 |
| 4,561,550 | 12/1985 | Franklin | 40/605 |
| 4,566,211 | 1/1986 | Gustafson | 40/605 |
| 4,574,336 | 3/1986 | Mikalonis | 362/260 |
| 4,674,211 | 6/1987 | Pratt | 40/564 |

*Primary Examiner*—Gene Mancene
*Assistant Examiner*—Weinceslao J. Contreras
*Attorney, Agent, or Firm*—Richard C. Willson, Jr.; Donald E. Zinn

[57] ABSTRACT

A wrap around valance system physically mounted to the top of a convenience store interior wall system, beneath the ceiling, is formed of end abutting, horizontally aligned, standard size interchangeable illuminated and non-illuminated modules of fabricated sheet metal formed with open front windows slidably mounting respectively, color display photo panels and color graphic decor panels. The non-illuminated modules have at least two sets of top and bottom facing open ended horizontal slots so that a color graphic display card may be superimposed over the color graphic decor panel to display temporary or seasonal information. A continuous wiring system is formed within the end to end coupled modules with electrical junction boxes mounted, respectively to opposite end walls of each illuminated module leading to a fluorescent lamp mounted internally of the illuminated module housings for backlighting of the photo panels. One or more short length non-illuminated modules bearing top and bottom extrusions of lengths equal to the gap between standard length modules for a given valence system section slidably receive a color graphic decor panel of a length equal to the extrusions to complete a section of the valance system.

5 Claims, 2 Drawing Sheets

MODULATED INTERIOR VALANCE SYSTEM

FIELD OF THE INVENTION

This invention relates to display valances within convenience stores or the like extending completely around the vertical wall interior of the store below the ceiling, and more particularly, to a valance system formed of modular sections, of common size, of illuminated and non-illuminated form and having changeable display panels.

BACKGROUND OF THE INVENTION

Existing merchandising valance systems for convenience stores or the like usually consist of permanent bands of color-graphics applied to the interior walls of retail establishments to attract the attention of customers to product areas or to exhibit special information. Such permanent valance system color graphics displays, being inflexible, fail to attract customer attention over time an normally lack any means for changing the information displayed within or on the valance system.

It is therefore a primary object of this invention to provide an improved merchandising valance system for mounting in continuous strip form about the interior walls of convenience stores or like retail establishments which utilizes interchangeable illuminated and non-illuminated modular units for both color graphic and illuminated specific photo stations and which further includes a non-illuminated modular unit whose length may be readily adjusted to complete banding about the room interior walls without gaps, and which may be applied to newly constructed retail stores or for retrofit application to upgrade older retail stores.

It is a further object of the present invention to provide such a valence system which permits superpositioning of graphic cards over non-illuminated color graphic decor panels of non-illuminated module units, which facilitate easy exchange of complete illuminated and non-illuminated modules from wall to wall, and which provides continuous wiring access throughout the modules to eliminate individual and separate service to the individual walls supporting modules of the interior valance system.

SUMMARY OF THE INVENTION

The invention is directed to a wrap around, modulated valance system mounted about the vertical interior walls of a convenience store or the like, below the store ceiling. The system comprises a plurality of end-to-end coupled interior wall mounted unitary panel display modules. The modules comprise similar sized, interchangeable, randomly positioned illuminating modules and non-illuminating modules. Each module has a fabricated sheet metal housing formed of integral, edge joined longitudinally spaced end walls, vertically spaced top and bottom walls and a rear wall with said walls defining an open front window within said housing. Each module includes a frame about the window with the frame including at least one set of top and bottom facing, open ended horizontal slots. Panels sized to the frames have top and bottom edges slidably mounted within respective ones of at least one set of the frame slots to close off the open front windows of said modules.

The valance system further comprises a continuous wiring system within the end-to-end coupled modules including electrical junction boxes mounted, respectively to opposite end walls of each illuminated module and electrical wires extending within each module connecting respective boxes thereof. Each illumination module includes at least one electrical lamp mounted internally of the housing and connected to the internal electrical wires carried by the module. Means are provided for mechanically mounting the modulus to the interior vertical walls of the convenience store or the like with end walls of adjacent modules abutting. The non-illuminated modules have a frame including two sets of top and bottom horizontal slots which face each other. A non-illuminated, semipermanent graphic decor or display panel is positioned within one set of facing slots of the non-illuminated module frame and a non-illuminated transient color graphic display card has upper and lower edges respectively positioned within another set of facing slots of said non-illuminated module frame and superposed over the semipermanent color graphic panel of said non-illuminated module. The illumination modules have a light transmitting photo panel backlighted by said at least one lamp thereof.

Preferably, a pair of short length non-illuminated modules may be spaced longitudinally from each other, fixedly mounted on a common vertical interior wall of the store and in line with the similarly sized illuminated and non-illuminated modules and wherein, top and bottom extrusions link the short length modules and bridge the gap between the short length modules with the extrusions each include at least one facing, open slot for slidable support of a color graphic decor panel of a length equal to the two short length modules and the gap therebetween thereby complimenting the other modules, and completing non-broken valance sections over the full length of respective vertical interior walls bearing the modular valance system. A flat bottom plate may also be provided to bridge across the gap between the pair of short length modules at the bottom. The bottom plate includes ends fixedly mounted to the bottom walls of the short length non-illuminated modules to respective sides thereof.

DESCRIPTION OF THE PREFERRED EMBODIMENT

Figure 3:
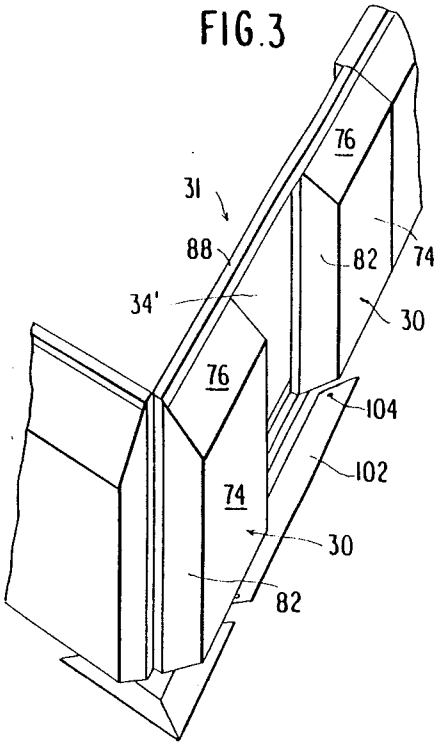
FIG. 3 is a perspective view of a portion of the interior valance system of FIG. 1, further illustrating the makeup and assembly of a short length non-illuminated modules to form an adjustable unit at the end of a given section of the interior valance sized to the vertical interior wall upon which said section is mounted.
Figure 2:
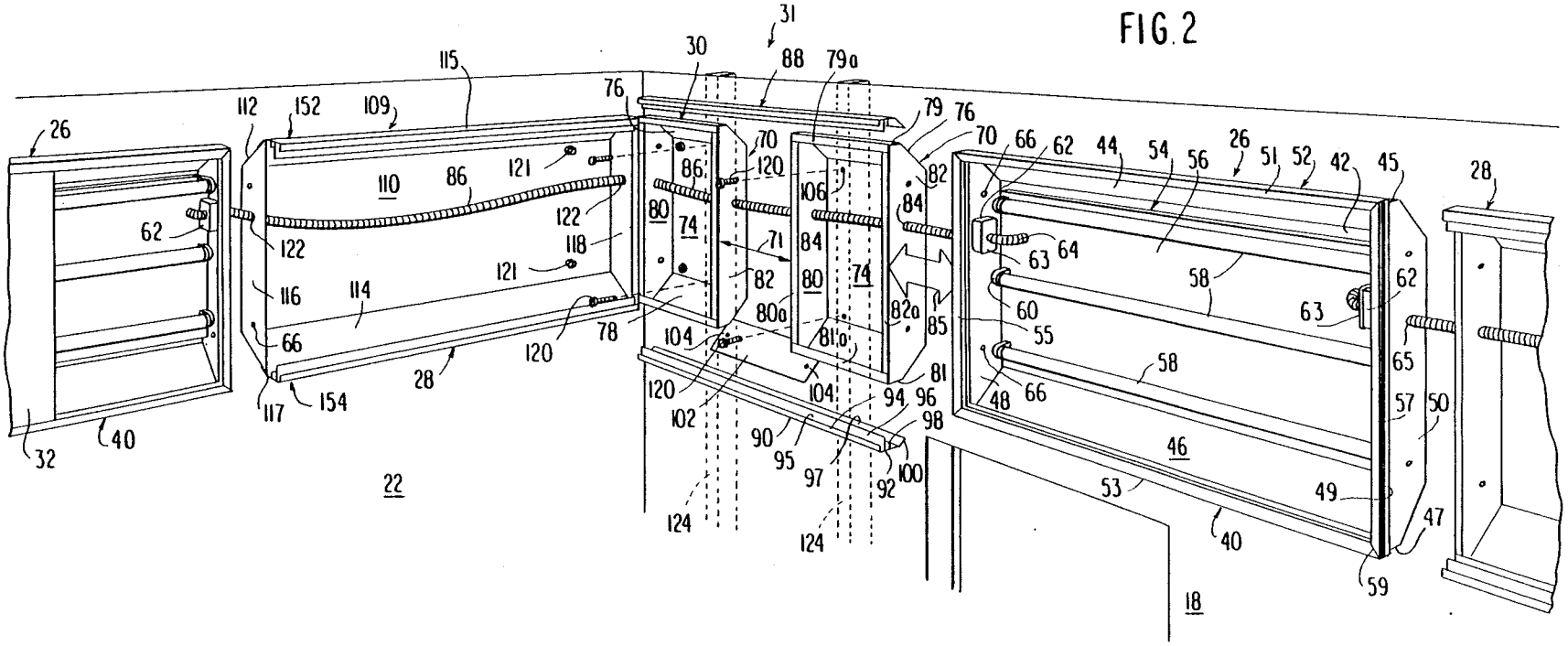
FIG. 2 is an exploded, perspective view of a portion of an interior valance system such as that shown in FIG. 1 and illustrating the nature of the electrical connections between the fluorescent lamp units within the illuminated modules, the mounting of the pair of short length non-illuminated modules in longitudinally spaced side-by-side position, and the coupling of top and bottom extrusions thereto.

Referring to the drawings, a preferred embodiment of the modulated interior valance system is shown in general at 10 as mounted below the ceiling and in a continuous band form about plural vertical interior walls within a convenience store indicated generally at 12. The interior vertical walls define a retail sales space indicated generally at 14 and include linked a two part front wall 16, a rear wall 18, parallel to front wall 16, an oblique vertical interior wall 20, and opposed end walls 22, 24. The convenience store in typical fashion includes a front wall section of vertical floor to ceiling windows indicated at W and a pair of front doors D providing access to the interior of the convenience store. The interior valance system consists of a plurality randomly positioned illuminated modules 26 and similar sized, non-illuminated modules 28. The illuminated and non-illuminated modules 26, 28 are of the same overall length and considerably longer than the short length non-illuminated modules indicated generally at 30 and partially forming non-illuminated adjustable units 31 fitted where necessary, and appropriately at one end or another of a given vertical interior wall, 16, 18, 20, 22, 24. In applicant's system, standard sized modules are installed and the remaining areas too small for standard equal length and equal sized illuminated and non-illuminated modules 26, 28, respectively are special fitted with non-illuminated adjustable units 31, as best seen in FIGS. 2 and 3. Thus, the majority of the valance units within a store location are installed preassembled. The exceptions are the non-illuminated adjustable unit 31 at a given corner or corners.

As will be appreciated hereinafter, each non-illuminated adjustable unit 31 consist of a pair of 2 foot short length non-illuminated modules 30 mounted at either end of a given leftover horizontal space adjacent a given corner, i.e., end of a vertical wall mounted valance section and mitered top and bottom extrusions which bridge the gap therebetween. The extrusions physically connect the 2 foot modules 30 together and facilitate the slidable mounting and support of a color graphic, decor face panel 34' cut to size and assembled by the installer on a location basis.

Since upper and lower extrusions which couple the 2 foot modules together at the top and bottom have double slots, the outermost pair of slots for these two extrusions permit the horizontal sliding of a vertically oriented easy-change color graphic display card 36 in front of the color graphic decor face panel 34' borne by the facing upper and lower slots proximate to the 2 foot modules at each non-illuminated adjustable unit 31. Such easy change color graphic cards 36 are similarly slidably positioned and held in superposed position over the color graphic decor face panel 34 of the full length non-illuminated modules 28 at each location.

Each face panel such as that at 34 is of a length complimenting the length of the non-illuminated module 28 housing. In the illustrated embodiment, both non-illuminated modules 28 and the illuminated modules 26 are of a length of 73½". This is in significant contrast to the 2 foot length of the non-illuminated adjustable unit modules 30.

Figure 1:
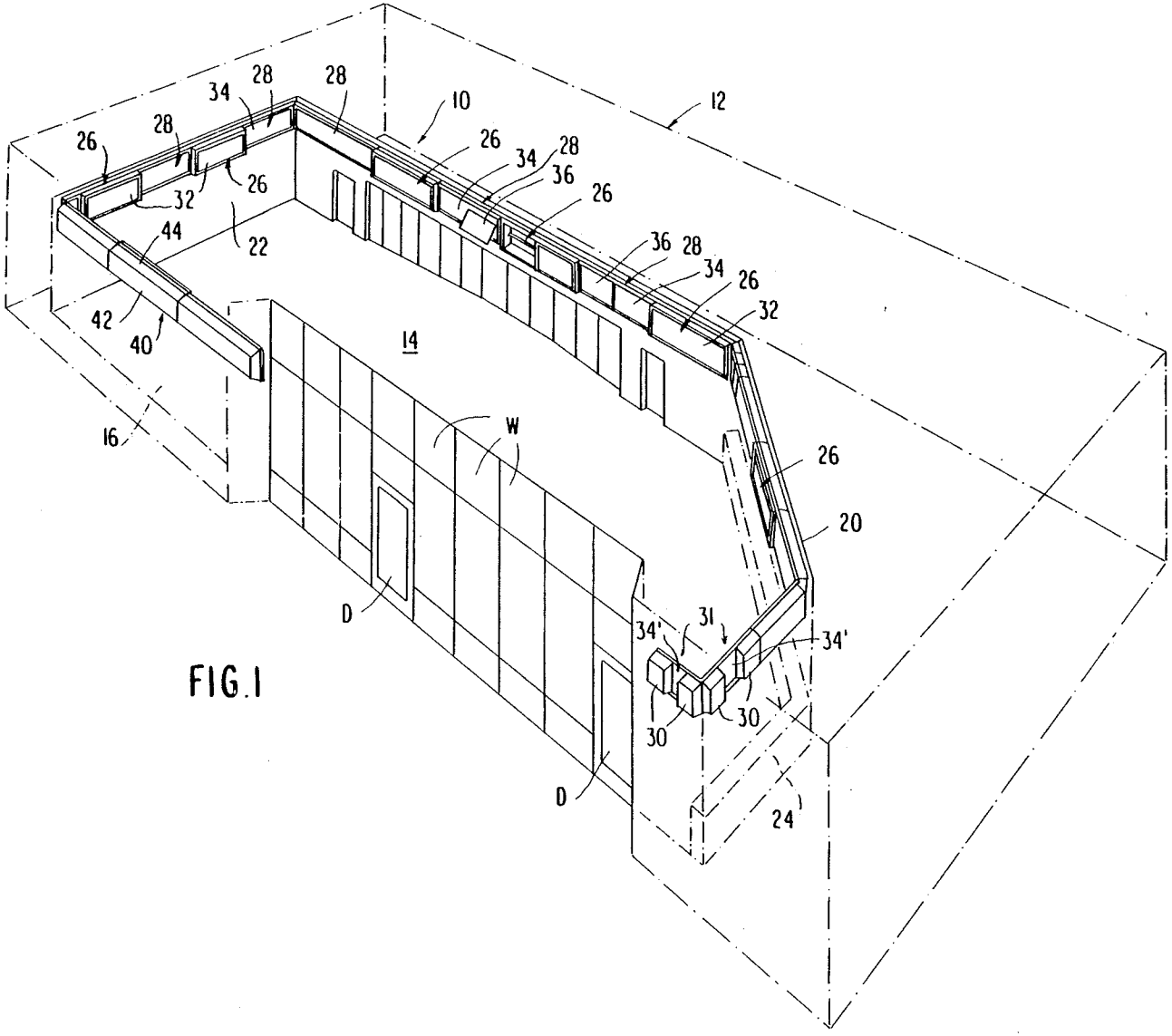
FIG. 1 is a partial perspective, partial schematic view of a convenience store incorporating an interior valance system forming a preferred embodiment of the invention.

Additionally, as seen in FIGS. 1, 2 and 3, translucent rigid pictorial panels 32 may be slid horizontally from either end of the illuminated modules 26, and each is of a length equal to the length of the module 26 itself so that it occupies the full window of each illuminated module 26 and blocks the view to the interior. Fluorescent tubes or the like interiorly of the illuminated modules backlight the content of the rigid pictorial panel 32 at each illuminated module 26 location.

From FIG. 2, it is apparent that the standard length illuminated modules 26 and the standard length non-illuminated modules 28 may have identical sheet metal housings, while for the non-illuminated adjustable units 31, the short length (2') non-illuminated modules 30 are of the same configuration, and same vertical height, but are considerably shorter in length than modules 26, 28.

The standard length (73½ inch) illuminated module 26 is comprises principally of a standard length sheet metal housing indicated generally at 40, having a rear wall 42, integral at the top and bottom with inclined or oblique walls 44, 46, respectively, and terminating in a flat horizontal top wall 45 and a horizontal bottom wall 47. The front of the housing 40 is open, while opposite ends are closed by parallel end walls 48, 50. The metal housing 40 may be formed of a single sheet of break metal aluminum with baked enamel finish and which is cut and stamped into the form shown in FIG. 2, that is of shallow pan form. A special extruded aluminum cover frame indicated generally at 52 is attached to the open front of the illuminated module housing 40 to allow easy, fast photo panel changes consisting of horizontal top and bottom portions 51, 53, respectively, and vertical end portions 55, 57 fixedly mounted to end walls 48, 50, respectively. The extrusion sections 51, 53, 55, 57 are joined at opposite ends to other sections at right angles, and via mitered corner joints 59. The special extruded aluminum cover frame 52 of the illuminated module housing 40 has slots 49 at opposite ends to permit the photo panels 32 to be slid into position, covering the open faced illuminated module housing 40. In the illustrated embodiment, each standard illuminated module 26 is provided with a fluorescent lamp indicated generally at 54, consisting of a rectangular base 56 of an overall length equal to the length of housing 40, being fixedly mounted to the rear wall 42 and carrying on front face thereof, three fluorescent tubes 58 supported by fluorescent tube terminals 60 at opposite ends thereof. The fluorescent tubes 58 are parallel to each other and horizontal, and are spaced so as to uniformly illuminate the rear side of the photo panel 32, when slid into place within the cover frame 52. Electrical junction boxes 62 are mounted to the opposite end walls 48, 50 interiorly of the sheet metal housing 40 having removable covers 63 through which cables 64 project which lead to the fluorescent lamp base 54 providing the electrical connections to respective terminals 60 mounting the fluorescent tubes 58 at opposite ends.

The fluorescent lamp 54 is standard, as are all material employed in the construction of the valance system. Holes are provided at 65 within respective end walls 48, 50 of the illuminated modules 26 through which pass the ends of electrical cables 86 linking the illuminated modules 26 throughout the system so that an electrical connection may be made to a source of electrical power and control switches for the complete valance system or at least for all components on a given vertical interior wall. Alignment holes 66 are provided at one or more locations within end walls 48, 50 which are identically sized and positioned to corresponding alignment holes within the non-illuminated modules 28 and the non-illuminated short length modules 30 for the non-illuminated adjustable unit 31.

In the cutting and stamping process of the sheet metal employed in forming housing 40, it may be desirable to integrally cut and bend the edges of the top and bottom walls 45, 47 of housing 40 and end walls 48, 50 to provide narrow flanges, such as those at 45*a* about the open window defined by the housing 40, which flanges are complimentary to the four sections of the extruded aluminum cover frame 52. Further, in joining the mitered edges of the extruded sections 51, 53, 55, 57 of the aluminum cover frame 52, L-shaped connectors may be mounted interiorly with respective legs projecting into the right angle abutting frame section and maintain in place by one or more screws passing through the frame sections and screwed into the L-shaped connectors.

The same structure and technique is employed in the manufacture of the non-illuminated modules 28 and short length modules 30 for the non-illuminated adjustable unit 31.

The non-illuminated modules 28 may be formed principally of an open open faced sheet metal housing indicated generally at 109 of a single piece of sheet metal of break metal aluminum with baked enamel finish with the housings 40 and 109 being identical, the exception being that the non-illuminated modules 28 are devoid of provisions for internal horizontal strip lighting, that is devoid of the fluorescent lamp 54. As such, a flat vertical rear wall 110 is formed integrally with upwardly oblique wall 112 and downwardly oblique wall 114 at the top and bottom thereof which walls 112, 144, in turn are integral with a flat horizontal top all 115 and a parallel opposed bottom wall 117, respectively. Vertical flat end walls 116 and 118 complete housing 109. The edges of these respective walls, where they meet adjacent other walls of the housing, are appropriately soldered together or mechanically fixed to each other by equivalent means. The rear wall 110 of module 28, similar to the rear wall 42 of module 40, is drilled on site with mounting holes 121 for mounting screws 120 which permit mounting of modules 26, 28 and 30 to the vertical building interior wall as for instance to studs 124, FIG. 2. Paired holes 122 are formed within opposite end walls 116 of the non-illuminated unit through which flex conduit 86 passes which links the illuminated modules 26 via electrical connection boxes 62.

As mentioned previously, due to the irregular length of the various partition walls or other interior walls of the building mounting the valance system 10, it is necessary to fill the space leftover upon placement of standard similar length illuminated modules 26 and non-illuminated modules 28 at desired locations in side abutting and aligned positions as seen in FIG. 1. FIG. 2 illustrates in its exploded view, the nature in which the non-illuminated adjustable unit 31 meets the space limitation between two standard units 26, 28 at a corner of the retail store space 14. In this illustrated example, the vertical studs 124 which are shown in dotted line form, are at longitudinally spaced positions and suitable for screw mounting of the modulus 30 in respective side-by-side but laterally spaced positions. Each short length module 30 consists of a sheet metal housing 70, again, preferably formed to break metal aluminum with baked enamel finish, and being cut and stamped in the manner described with respect to housings 40 and 109. Each housing 70 is therefore provided with a rear wall 74, integral oblique upper and lower walls 76, 78, respectively leading to flat horizontal top and bottom walls 79, 81, respectively and with the open front housing 70 being closed at opposite ends by end walls 80, 82. Right angle front flanges are clearly seen in FIG. 2 as extensions at 79*a* for the top wall 81*a*, for the bottom wall 80*a*, and at 82*a* for end walls 80 and 82, respectively. The addition of the flanges adds rigidity to the housings 70. Holes 84 are formed within respective end walls 80, 82 through which the flex conduit 64 passes in making the electrical connection between fluorescent lamps 54 for the illuminated modules 26 to the right, FIG. 2, and that shown to the left on the adjacent right angle end wall 22. Additionally, holes are provided on site, at 106, for mounting via screws 120 within the vertical rear walls 74 of the two short length modules 30 for the non-illuminated adjustable unit 31. The screws 120 are readily received by the vertical studs 124 of the rear interior wall 18.

While the majority of the valance modules or units within a store location are assembled, the exception lies in the non-illuminated adjustable corner units 31. In the illustrated embodiment, a pair of 2' (short length) modules 30 are mounted to wall 18 so that the module 30 to the left, FIG. 2 has its end wall 80 at right angles to end wall 118 of the non-illuminated module 28 mounted to the building interior side wall. The right hand short length module 30 of unit 31 is shown as spaced by a gap indicated at 71 from the left hand module 30 of unit 31, in the exploded view, FIG. 2, but in a position such that its end wall 82 may be placed flush with end wall 48 of the illuminated module 26 to the right thereof. The large headed arrow 85, FIG. 2, is indicative of the necessity for the illuminted module 26 to be mounted such that wall 48 thereof is brought into a flush abutment with end wall 82 of the short length module 30 of unit 31 proximate thereto. On site, upper 88 and lower 90 aluminum extrusions are cut to length so as to span the lateral width of the two modules 30 and gap 71.

The extrusions 88, 90 are mirror images of each other and as shown, extrusion 90, is provided a horizontal base 92 from which, three vertical walls project upwardly at right angles thereto; a front wall 94 of short height, a middle vertical wall 96 of extended height, and a third vertical wall 98 to the rear of wall 96 and of a height intermediate of that of front wall 94 and center wall 96. To the rear, the extrusion 90 is provided with an oblique base terminal portion 100 which matches the angulation of oblique wall 78 of the short length modules 30. As such, the three vertical walls 94, 96 and 98 define respective twin grooves 95, 97 to the front and rear of the vertical wall 96. The rear groove 97 matches a similar rear groove within the upper extrusion 88 and slidably receives a primary color graphic decor panel such as that at 34' (cut to the same length as the extrusions 88, 90, while the aligned front grooves 95 of the upper and lower extrusions 88, 90 receive, respectively the upper and lower edges of a temporary or seasonal graphic display card 36. In mounting the modules, the provision of alignment holes 66 within the end walls of all of the module housings 40, 70 and 109 permits, by temporary passage of a rod sized to the diameter of the holes, horizontal alignment of all modules for a given vertical wall such as rear wall 18, side wall 22, etc., prior to screw mounting the modules to vertical studs 124. Additionally, the modules may be coupled together by bolts or the like (not shown) passing through the same holes and receiving nuts (not shown) complimenting the mounting of the modules by way of their vertical rear walls to studs 124 by wood screws 120.

Figure 4:
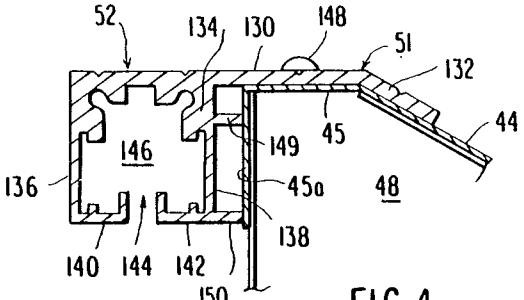
FIG. 4 is an enlarged, sectional view of a portion of the illuminated module illustrating the cross sectional configuration of the upper extrusion for slidably supporting a rigid pictorial panel within the window thereof for backlighting illumination.

Referring to FIG. 4, the enlarged view shows the cross sectional configuration of the extrusion 51 for the aluminum extrusion frame 52 which is fixed to an extends along the upper horizontal wall 45 of the sheet metal housing 40 of a given illuminated module 26, FIG. 2. The portion of the housing 40 illustrated in FIG. 4, includes the oblique wall 44, the top wall 45 and end wall 48. The extrusion includes a flat base 130 which overlies top wall 45 and through which passes a series of rivets as at 148 for physically coupling the extrusion to housing 40. Base 130 has an oblique terminal portion 132 matching the angulation of housing oblique wall 44 and which rests against the outer surface of that wall 44 of the housing. To the opposite side, a pair of vertical walls 134, 136 extend from base 130, parallel to each other and parallel to vertical flange 45*a* of the housing top wall 45. Walls 138, 136 include right angle flanges 140, 142 which are directed towards each other but terminate short thereof to form a narrow vertical slot 144 leading to an enlarged interior cavity or chamber 146 which runs the length of the extrusion. Further, a pair of horizontal tabs 149, 150 extend from vertical wall 138 to abut the flange 45*a* of the sheet metal housing top wall 45. The result is a highly rigid structure forming an appropriate slot for receiving the upper edge of a slidable photo panel 32, when photo panel 32 is side inserted into slot 144 so as to close off the interior of housing 40, permitting backlighting of the photo panel by fluorescent lamp 54, FIG. 2.

Figure 5:
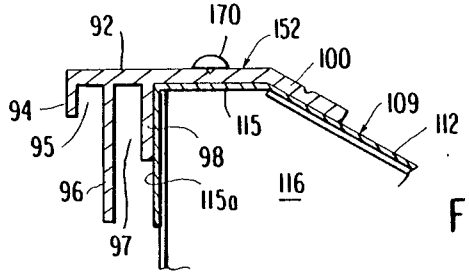
FIG. 5 is an enlarged, vertical sectional view of a portion of the non-illuminated module showing the configuration of the upper extrusion for supporting, selectively or in superposed position, a color graphic panel and an easy-change graphic card, respectively within respective slots formed therein.

Reference to FIG. 5 shows an enlargement of the upper extrusion indicated generally at 152 for non-illuminated module 28, of identical cross section to extrusions 88, 90 and which is fixedly mounted to and extends horizontally across the top wall 115 of housing 109. Extrusion 152 has a base 92 whose terminal portion 100 is oblique in face abutment with the oblique wall 112 of housing 109. The housing top wall 115 terminates in a vertical flange 115*a* at the open face of the housing 109. Placed flush against flange 115*a* is an integral intermediate length vertical, rear wall 98 of the extrusion, a central wall 96 and the front wall 94 projecting at right angles from base 92 of the extrusion with spaced walls 94, 96 defining a front slot 95 and spaced walls 96, 97 defining rear slot 97. A series of rivets 170 mount the base 92 to the flat horizontal top wall 115 of housing 109.

Where the remaining horizontal space at a corner between valance system sections is too short to permit placement of two short length modules 30 to be covered by a color decor panel 34, but where such gap or space is wider than the width of a short length module 30, a single short length module 30 may be mounted to the vertical wall, and top and bottom extrusions 88, 90 centered on the single module and having ends extending outwardly from opposite ends, well beyond end walls 80, 82 of that module, such that the ends of the extrusions are in abutment with the ends of adjacent modules such as modules 26, 28 in accordance with FIG. 2. A color decor panel 34 of desired length is slidably mounted to the extrusions via top and bottom edges thereof. Additionally, since the bottoms of the various modules 30 are visible, since the valance system unit 31 projects interiorly of the room or retail sales space 14, it is desirable that a short length bottom cover 102 of rectangular form be mounted, at opposite ends at an oblique angle, to oblique walls 78 of respective short length modules 30. With the bottom cover being of a width in excess of the gap 71 between end walls 80, 82 of adjacent short length modules, FIG. 3, the bottom cover 102 may be screwed to the oblique walls 78 of respective short length modules via screws such as 120 passing through screw holes 104 within that bottom cover.

From the above, it is readily apparent that certain advantages exists with the modulated interior valance system of the present invention. Not only is there an easy exchange of photo and rigid graphic decor panels 32, 34, respectively, but also easy exchange of complete illuminated and non-illuminated standard length modules 26, 28 from wall to wall. The continuous wire access provision allows the electrical circuits to pass from module to module without the necessity of individual and separate service from the rear wall to each illuminated module 26. The photo panels 32 may constitute graphic display panels which are gloss, full colored transparencies, laminated to clear plastic sheets of a thickness on the order of $\frac{1}{8}$ of an inch or the like. In turn, the rigid graphic decor panels 34, 34' may be fiberglass opaque embedment of printed color graphics in $\frac{1}{8}''$ thickness permitting easy cleaning and superior maintenance.

While the invention has been particularly shown and described with reference to a preferred embodiment thereof, it will be understood by those skilled in the art that the foregoing and other changes in form and details may be made therein without the parting from the spirit and scope of the invention.

What is claimed is:

1. A wrap around modular valance system for mounting about the tops of vertical interior walls of a convenience store or the like, said valance system comprising: a plurality of end-to-end coupled interior wall mountable unitary graphic panel display modules; said modules comprising similarly sized, interchangeable, randomly positioned illuminated modules and non-illuminated modules; each module being formed of a fabricated sheet metal housing defined by integral, edge joined longitudinally spaced end walls, vertically spaced top and bottom walls and a rear wall, said walls defining an open front window within said housing; a frame about said window; said frame including at least one set of top and bottom, open ended horizontal slots facing each other; graphic display panels sized to and having top and bottom edges slidably mounted within respective slots of said at least one set of said frame slots and closing off said open front window; said valance system further comprising a continuous wiring system within said end-to-end coupled modules, said continuous wiring system comprising electrical junction blocks within respective end walls of each illuminated module and electrical wires extending through end-to-end abutting modules and connecting respective junction blocks; said illuminated modules including at least one electrical lamp mounted internally of said housing and connected to said electrical wires carried by said illuminated modules via said electrical junction blocks, means for mechanically mounting said modules in horizontal end abutting alignment to the interior walls of said convenience store or the like and means for mechanically connecting the end walls of adjacent modules together; and wherein, said non-illuminated modules have frames including two sets of top and bottom, horizontal slots facing each other and wherein, a non-illuminated semi-permanent color decor panel is sildably mounted within one set of slots and a non-illuminated transient graphic card is selectively slidably mounted within another set of slots and superposed over the semipermanent graphic color panel; and wherein, said graphic panel for said illuminated module comprises a light transmitting photo panel backlighted by said at least one lamp.

2. The wrap around modular valance system as claimed in claim 1, further comprising an at least one short length, non-illuminated module of a length shorter than that of said similarly configured, interchangeable randomly positioned illuminated and non-illuminated modules, said at least one short length non-illuminated module is fixedly mounted on a vertical interior wall horizontally in line with said similarly sized illuminated and non-illuminated modules and wherein, top and bottom extrusions are fixedly mounted to the top and bottom of said short length non-illuminated module and being of a length so as to bridge the gap between the similarly sized illuminated or non-illuminated modules proximate thereto, said extrusions bridging the gap each including at least one facing, open slot slidably supporting a graphic color decor panel of a length equal to that of the extrusions thereby complementing the valance system modules over the full length of the vertical exterior wall bearing said short length non-illuminated module and said similarly sized, interchangeable illuminated and non-illuminated modules.

3. The wrap around modular valance system as claimed in claim 2, wherein said at least one short length non-illuminated module comprises a pair of short length non-illuminated modules spaced longitudinally from each other and fixedly mounted in end abutment, respectively with randomly positioned, similarly sized interchangeable illuminated and non-illuminated modules proximate thereto and wherein, sait top and bottom extrusions extend the full length of said pair of short length non-illuminated modules to link the short length modules and bridge the gap between the similarly sized interchangeable randomly positioned standard length modules.

4. The wrap around modular valance system as claimed in claim 3, further comprising a flat bottom plate bridging across the bottom of said pair of short length modules and having opposite ends fixedly mounted to the bottom walls of respective short length non-illuminated modules.

5. The wrap around modular valance system as claimed in claim 1, further comprising aligned holes within the end walls of each of said modules sized to and receiving flex cable electrically connecting electrical junction boxes fixedly mounted to the end walls of the illuminated modules and wherein, said end walls of said modules include aligned, small diameter alignment holes at uniform positions to facilitate the alignment of modules laterally across the vertical interior walls of the convenience store or the like, preferably each of the housings are formed of a single sheet metal strip bent into appropriate configuration having a back wall, integral oblique walls at the top and bottom thereof and terminating in integral flat horizontal top and bottom walls and wherein, preformed end caps of a matching configuration are spot welded to the bent sheet metal opposite ends to complete a housing including narrow flanges about all four sides thereof defining an open front window therein.

* * * * *